US007662070B1

(12) United States Patent
Mann

(10) Patent No.: US 7,662,070 B1
(45) Date of Patent: Feb. 16, 2010

(54) RECUMBENT BICYCLE FOR DISABLED USERS

(76) Inventor: Michael N. Mann, 14202 Selva La., Orland Park, IL (US) 60462

( * ) Notice: Subject to any disclaimer, the term of this patent is extended or adjusted under 35 U.S.C. 154(b) by 0 days.

(21) Appl. No.: 12/228,502

(22) Filed: Aug. 14, 2008

(51) Int. Cl.
*A63B 22/06* (2006.01)

(52) U.S. Cl. ..... 482/57; 482/51

(58) Field of Classification Search ..... 482/51, 482/57, 58, 59, 62, 4, 751, 908; 601/22, 601/23, 24, 26, 27, 32, 33, 34, 35, 36
See application file for complete search history.

(56) References Cited

U.S. PATENT DOCUMENTS 2,895,281 A * 7/1959 Young et al. ..... 56/221
3,713,438 A 1/1973 Knutsen
4,592,544 A 6/1986 Smith et al.
5,033,736 A 7/1991 Hirschfeld
5,158,074 A * 10/1992 Grellas ..... 601/24
5,269,736 A * 12/1993 Roberts ..... 482/62
5,419,752 A 5/1995 James et al.
D362,699 S * 9/1995 Heaton et al. ..... D21/666
5,580,337 A * 12/1996 Habing et al. ..... 482/57
5,616,106 A 4/1997 Abelbeck
5,695,248 A * 12/1997 Bell ..... 297/344.17
6,077,201 A 6/2000 Cheng
6,409,631 B1 * 6/2002 Alessandri ..... 482/4
6,902,515 B2 * 6/2005 Howell et al. ..... 482/62
7,137,929 B2 11/2006 Fan
7,150,483 B2 * 12/2006 Rasmussen ..... 296/26.14
7,267,637 B2 9/2007 Mercado et al.
7,341,310 B1 * 3/2008 Ross ..... 297/344.17
2002/0155927 A1 * 10/2002 Corbalis et al. ..... 482/52
2003/0045402 A1 * 3/2003 Pyle ..... 482/51
2005/0064998 A1 * 3/2005 Hill ..... 482/57
2005/0164839 A1 * 7/2005 Watterson et al. ..... 482/54
2008/0085819 A1 * 4/2008 Yang ..... 482/62

* cited by examiner

*Primary Examiner*—Loan H Thanh
*Assistant Examiner*—Tam Nguyen
(74) *Attorney, Agent, or Firm*—Richard L. Mikesill

(57) ABSTRACT

A recumbent bicycle for use by disabled users. The bicycle includes a seat unit that is adjustable in both the horizontal direction and in the vertical direction as well as a pedal unit that has a motor for controlling both the time and rotational speed of pedals. Straps are located to hold the user in the seat unit. The pedals are oversized with respect to the user's feet and have a heel-engaging ledge as well as straps to hold the user's feet on the pedals.

3 Claims, 2 Drawing Sheets

RECUMBENT BICYCLE FOR DISABLED USERS

TECHNICAL FIELD OF THE INVENTION

The present invention relates to the general art of exercise equipment, and to the particular field of recumbent bicycles.

BACKGROUND OF THE INVENTION

It is a commonly known that regular exercise is linked to increased health and increased life expectancy. With today's automated lifestyles regular physical exercise is something that most people must consciously add to their daily activities. To make the most productive use of the person's time the design of particular machines are used to facilitate this process in a safer manner. For most people, much of the underlining goal is to reduce body fat. To do this the greatest amount of work must be accomplished by the exercising person. This will invariably utilize the larger muscle groups in the body, which include the legs. An optimal design will include the ability to exercise both aerobically at a low intensity for a long period of time and anaerobically at a high intensity for a shorter period of time and the device should be fun to use. If the person does not enjoy using the machine, it will inevitably end up in the garage.

Exercise and therapeutic training devices come in many forms. As is generally known, such exercise devices can include stationary bicycles such as those of the reclining and vertical type. Further to this extent, there are such devices that are simulated stepping machines which allow one to step upwardly and downwardly to simulate a climbing of stairs. Also well known are treadmills that simulate running, jogging, and walking vigorously.

There are other well known devices that not only include cycling but also efforts related to treadmill workouts. Treadmills generally permit a user to walk, jog or run on a stationary machine. However, they are considered impact devices which in some cases are not as beneficial to the user as for example a low impact device such as a bicycle whether it be a reclining or vertical bicycle or such stepping machines as are known in the art.

There are exercise trainers that are currently known in the art that simulate a running, walking, or jogging effort on a pair of pedals. These pedals are physically connected to cranks that are under a load. Such exercise trainers can have their pedals trace a path approximating an ellipse or what can be considered as a modified elliptical path. One of the drawbacks of such modified elliptical paths is that the major axis of the path is limited to being twice the crank's length.

Several types of exercise equipment are currently in use to provide exercise to persons who wish to keep physically fit without venturing out of doors. One of the most popular of the exercise devices has been the stationary exercise bicycle. Early exercise bicycles were very much like real bicycles, except mounted on stands that prevented the wheels from contacting the ground so that the pedaling of the bicycle turned the wheel but did not propel the bicycle. More sophisticated bicycle-simulating equipment has been developed through the years until the exercise bicycles of today, which sometimes do not even resemble standard bicycles and consist primarily of bicycle cranks driven by the feet of the exerciser and drivingly coupled, usually by a chain drive, to a flywheel to provide resistance to the pedal motion, thereby providing the exerciser with a force to work against. Both the appearance and the functional features of exercise bicycles are continuously undergoing change and improvement, however, the typical exercise bicycle still utilizes some sort of a chain-driven wheel, whether it be a lightweight spooked wheel of the true bicycle type or a heavier flywheel, that rotates in a vertical plane about an axis parallel to the axis about which the pedals are moved.

The construction and operation of a traditional indoor fitness bike primarily provides exercisers a direct exercise for both legs by simulating the pedaling movements of a bicycle. Of course, the fitness bike can come with a frictional resistance adjusting device, so that the exercisers can adjust the frictional force to an appropriate resistance to achieve the desired objective and effect of exercising the legs. Undeniably, the operation of a fitness bike of this kind surely has the exercising effect and objective. However, such simple operation method and exercise mode for providing the pedaling exercise is obviously monotonous and boring, and thus it is an adverse factor to the expected exercising effect.

There are many different exercise bicycles: the stationary bike, the upright bike and the recumbent bike. These devices have many benefits: they are affordable; they provide a much lower impact on your joints and ligaments than other piece of exercise equipment like a treadmill or stair climber. This can result in less chance of sustained injury over time and can also be great for people with joint problems, arthritis, etc.; they are much safer than other forms of exercise equipment. A user can slip and fall on a treadmill; a user can lose their balance on an elliptical trainer. It is much more difficult to fall off or injure one's self on an exercise bike. This makes the exercise bike a great alternative for the elderly exerciser or someone who is new to exercise equipment in general; a user can entertain himself while exercising, such as reading or watching television or watching a movie or the like; and most of these devices are more comfortable than other exercise devices.

Due to its comfort, the recumbent bike has gained popularity. The recumbent bike reclines at an angle. Many have bucket seats that offer back support. Many riders find less strain on their knees and back. The recumbent exercise bike provides the body with more relaxation while exercising. The body is more reclined than an upright exercise bike, and the seat will generally have a back to it for a resting position. For this reason, a recumbent bike is usually very beneficial for someone with back problems. Also, your legs will be out in front of you instead of below you, so resistance from the pedals may be a bit higher. The recumbent exercise bike is a fantastic machine for anyone who enjoys a more relaxing workout with less intensity, but it will still get your heart rate up and keep you active.

Due to the nature of their injuries, physically disabled persons, e.g., quadriplegics and paraplegics can not exercise the nonfunctional parts of their bodies. To preserve muscle tone and strength, the large muscle groups must be worked by some external means. These muscles may be worked by a physical therapist who will move the body parts that need work.

However, the inventor has observed that most exercise devices, including the above-discussed bikes and recumbent bikes, are not well suited to individuals who are either disabled or who have suffered an injury that prevents them from putting pressure on their joints. Therefore, the inventor has noted a need for an exercise device, specifically a recumbent bike, that can be used by a disabled individual or by one who cannot place pressure on his joints.

SUMMARY OF THE INVENTION

These, and other, objects are achieved by a recumbent exercise bike which is designed to offer the exercise benefits of a recumbent stationary bike to disabled individuals.

The pedals of the device are significantly larger than the pedals of prior art devices in order to help individuals with limited arm strength to engage the pedals. Velcro strips are also provided for a secure attachment of the user's foot to the pedals. The device further includes a display panel that has an on/off switch, a dial for controlling the reps per minute, a timer and a toggle switch. Once the timer is set, a motor is activated to rotate the pedals at the correct reps per minute and consequently move the user's legs in a repeated up and down motion. Precisely controlled rotation of the lower limbs while maintaining the feet in a constant plane produces a different muscle and joint exercise that relaxes and strengthens the muscles. Rapid improvement of muscle tone and flexibility will thus be possible.

The device of the present invention can promote improved circulation in the legs of disabled people. It can also be used by individuals who such as frail elderly individuals and arthritic patients, who cannot put a large amount of pressure on their joints. The device may also help alleviate muscle spasms for individuals disabled with spinal cord injuries.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawing and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
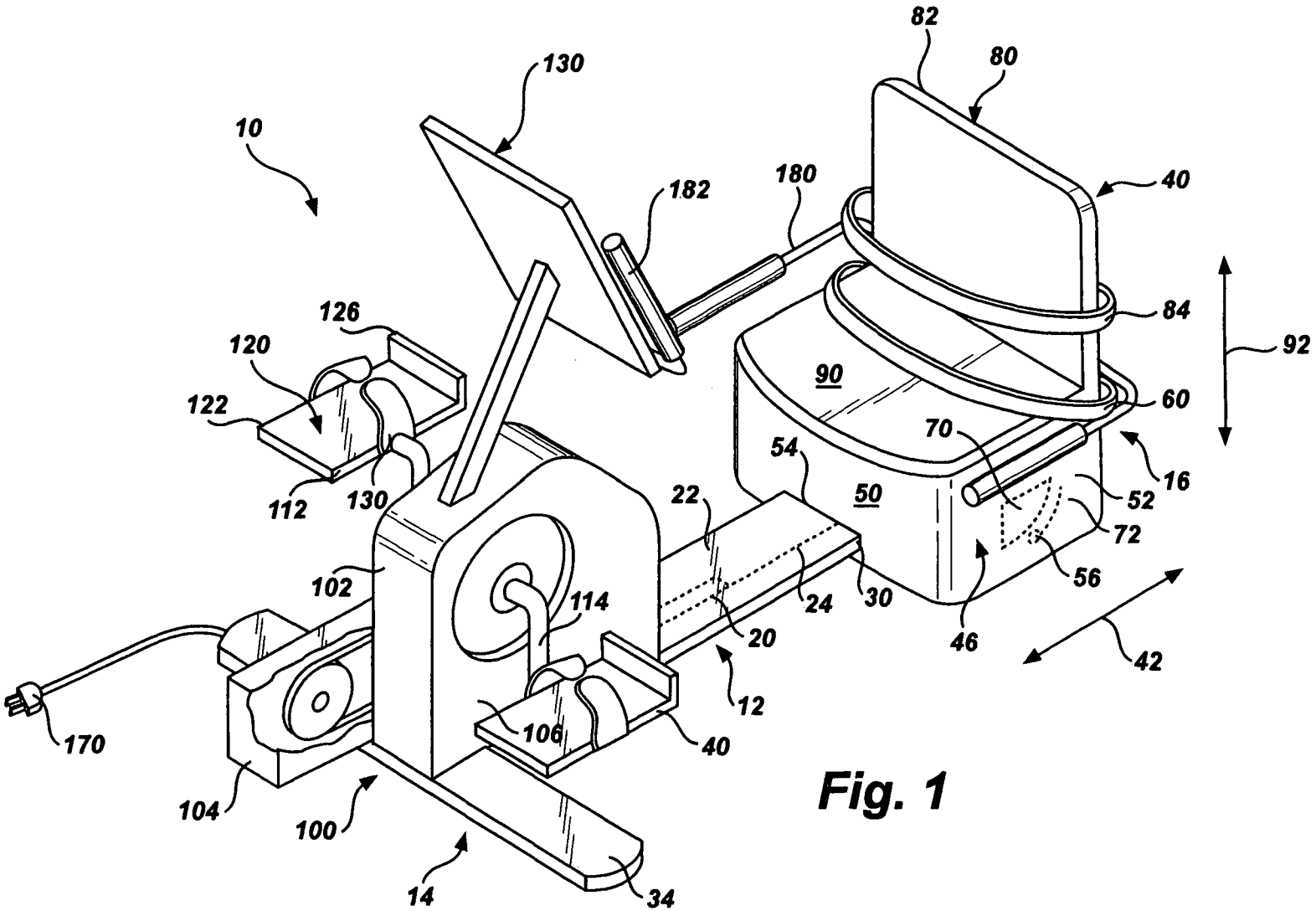
FIG. 1 is a perspective view of a recumbent bicycle embodying the principles of the present invention.
Figure 2:
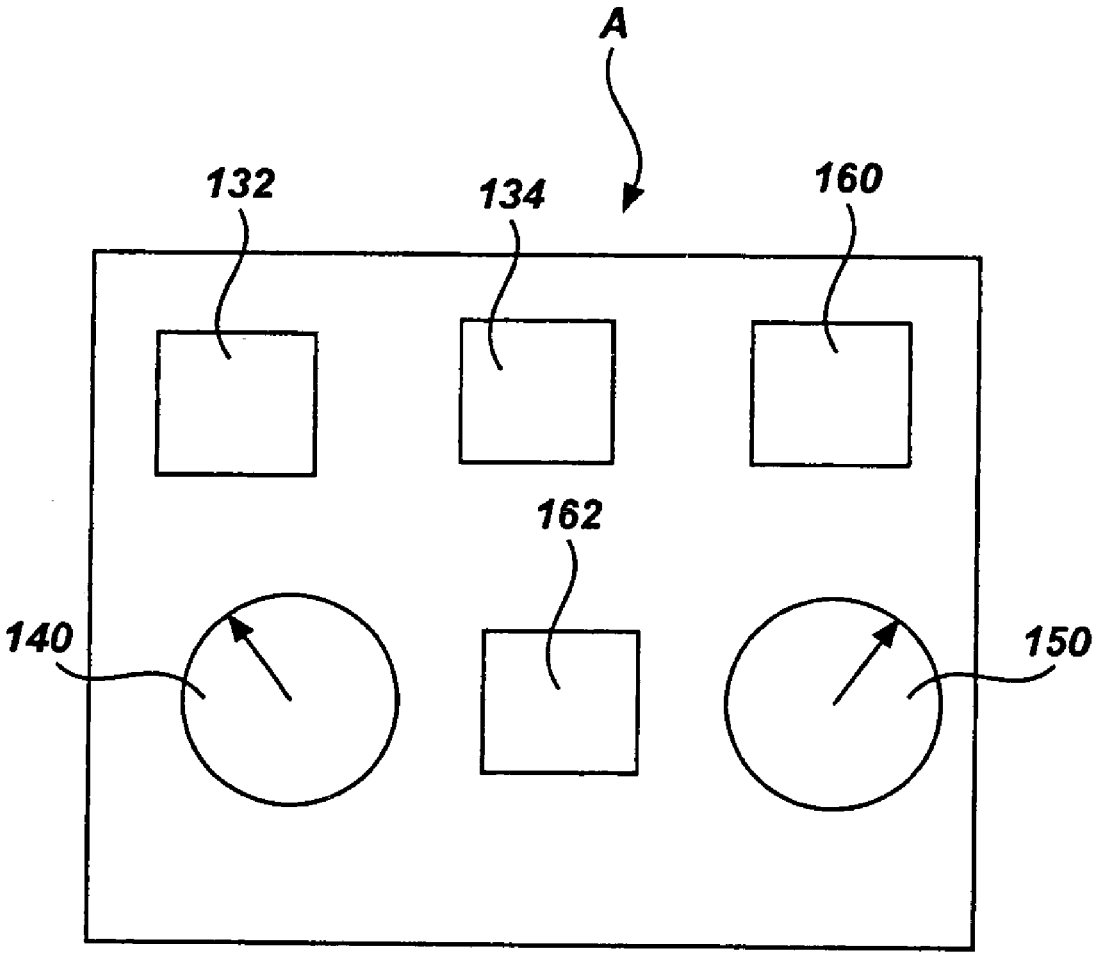
FIG. 2 illustrates a control unit for the bicycle shown in FIG. 1.

Referring to the figures, it can be understood that the present invention is embodied in a recumbent bicycle 10 for use by a disabled individual which comprises a support base 12 having a first end 14 which is a forward end when the base is in use, a second end 16 which is a rear end when the base is in use. and a longitudinal axis 20 which extends between the first and second ends of the support base. Base 12 has a first surface 22 which is a top surface when the support base is in use and a plurality of gear tooth accommodating holes 24 defined in the first surface of the support base to be spaced apart and to extend in the direction of the longitudinal axis. A second surface 30 is a bottom surface when the support base is in use A cross brace 34 is located adjacent to first end 14 of the base and is oriented transverse to the longitudinal axis of the support base. Support base 12 and cross brace 34 provide a stable support for bicycle 10.

A seat unit 40 is slidably mounted on the support base to slidable move in the direction of the longitudinal axis of the support base in directions indicated by double-headed arrow 42 from a first position located adjacent to second end 16 of the support base toward first end 14 of the support base and back. The slidable nature of the seat unit allows a user to properly position himself on the bicycle as will be understood from the teaching of this disclosure. Seat unit 40 includes a seat housing 46 which includes a first end 50 that is a forward end when the seat unit is in place on the support base. A second end 52 is a rear end when the seat unit is in place on the support base. Each of the first and second ends of the housing has a slot, such as slot 54, defined therethrough, with the slots being aligned with each other.

Seat unit 40 further includes a bottom 56 which is located beneath second surface 30 of the support base when the seat unit is in place on the support base whereby the support base slides through the seat housing with the seat housing being slidably supported on the support base. A lap strap 60 is fixedly mounted on the seat housing in a position to extend over a lap of a user to hold that user in place on the seat unit when activated. The lap strap can be in the nature of a seat belt or the like.

A motor unit 70 is located in the seat housing and has elements, such as gear 72, which operatively engaging gear tooth accommodating holes 24 defined in first surface 22 of the support base to move the seat unit in the direction of the longitudinal axis of the support base when the motor is suitably activated.

A back support unit 80 is mounted on the seat housing and includes a back-engaging element 82 fixedly mounted on the seat housing and a chest strap 84 fixedly mounted on the back-engaging element in a position to extend around a chest of the user to hold that user in place on the seat unit when activated. A seat element 90 is movably mounted on the seat housing to move toward and away from the support base in a vertical direction as indicated by double-headed arrow 92, so the height of the seat element relative to the support base can be adjusted. Seat element 90 is operatively connected to motor unit 70 to be moved when the motor element is suitably activated. The operative connection can include gear teeth, worm gears, or the like.

A pedal unit 100 is mounted on the support bar and on the cross brace adjacent to the first end of the support base. Pedal unit 100 includes a housing 102 and a motor 104 with an output portion 106 thereof located in the housing of the pedal unit. The output portion of motor 104 is shown as a belt, but could be other elements as well as will occur to those skilled in the art based on the teaching of this disclosure.

Two identical foot-accommodating pedals 110 and 112 are rotatably mounted on the housing of the pedal unit to rotate in a plane that is upright with respect to the support unit. The pedals are operatively connected to the motor in the pedal unit to be rotated by the motor of the pedal unit when the motor of the pedal unit is suitably activated. Each foot-accommodating pedal includes an L-shaped drive bar 114 connected to the motor of the pedal unit to be rotated when the motor of the pedal unit is activated and a foot-engaging plate 120 mounted on the drive bar for rotation therewith. Each foot-engaging plate includes a planar portion 122 that has a surface area greater than the surface area of a foot pad of the user to ensure that the user's foot remains solidly in place on the foot pedal. This is important for someone who may not have full control over his feet. A ledge 126 is located on one end thereof which extends outwardly from the planar portion and is located to engage a heel of the foot of the user when the pedal unit is in use. The ledge also ensures proper placement of the user's foot and that the foot will not fall off of the pedal during use of bicycle 10. A strap 130 is fixedly attached to the planar portion and encircles the user's foot to hold the user's foot on the foot-engaging plate when the pedal unit is in use.

The seat unit and the pedal unit are mounted on the support base relative to each other so that the user's legs extend in the direction of the longitudinal axis of the support base when the seat unit and the pedal unit are in use in the manner of a recumbent bicycle. As can be understood, the relative movement between the seat and the pedals allows a user to establish the most comfortable and workable position. This is very important for a disabled user.

A control unit 130 is mounted on the housing of the pedal unit and includes a first seat control button 132 operatively connected to motor 70 in the seat unit. First seat control button 132 is connected to the motor unit in the seat unit to activate that motor unit in the seat unit to move the seat unit in the longitudinal directions 42 of the support base. A second seat control button 134 is also operatively connected to motor 70 in the seat unit. Second seat control button 134 is connected to the motor unit in the seat unit to activate that motor unit in the seat unit to move the bottom of the seat housing in directions 92 to adjust the height of the seat housing with respect to the support base. A control dial 140 is operatively connected to motor 104 in the pedal unit to activate motor 104 to rotate the foot-accommodating pedals at a rotational speed that corresponds to a setting of control dial 140. A timer 150 is connected to motor 104 in the pedal unit. It is noted that either of the dials 140 or 150 can be digital or analog as suitable. An on/off switch 160 is connected to the motor of the seat unit, and an on/off switch 162 is connected to the motor of the pedal unit. The on/off switches are connected to the motor in a manner which controls power to those motors as received via power cord 170 which is connected to both motors.

A first handlebar 180 is mounted on the housing of the seat unit and a second handlebar 182 is mounted on the control unit.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A recumbent bicycle for use by a disabled individual comprising:

A) a support base having a first end which is a forward end when the base is in use, a second end which is a rear end when the base is in use, a longitudinal axis which extends between the first and second ends of the support base, a first surface which is a top surface when the support base is in use, a plurality of gear tooth accommodating holes defined in the first surface of the support base to be spaced apart and to extend in the direction of the longitudinal axis, a second surface that is a bottom surface when the support base is in use, and a cross brace which is located adjacent to the first end of the base and which is oriented transverse to the longitudinal axis of the support base;

B) a seat unit slidably mounted on the support base to slidable move in the direction of the longitudinal axis of the support base from a first position located adjacent to the second end of the support base toward the first end of the support base, the seat unit including (1) a seat housing which includes (a) a first end that is a forward end when the seat unit is in place on the support base, the first end having a slot defined therethrough through which the support base slidably extends, (b) a second end that is a rear end when the seat unit is in place on the support base, a slot in the second end of the seat housing being aligned with the slot in the first end of the seat housing, (c) a bottom which is located beneath the second surface of the support base when the seat unit is in place on the support base whereby the support base slides through the seat housing with the seat housing being slidably supported on the support base, (d) a lap strap fixedly mounted on the seat housing in a position to extend over a lap of a user to hold that user in place on the seat unit when activated, and (e) a motor unit, located in the seat housing, includes a gear operatively engaging the gear tooth accommodating holes defined in the first surface of the support base to move the seat unit in the direction of the longitudinal axis of the support base when the motor is suitably activated, (2) a back support unit on the seat housing and including (a) a back-engaging element fixedly mounted on the seat housing, (b) a chest strap fixedly mounted on the back-engaging element in a position to extend around a chest of the user to hold that user in place on the seat unit when activated, and (3) a seat element movably mounted on the seat housing to move toward and away from the support base so the height of the seat element relative to the support base can be adjusted;

C) a pedal unit mounted on the support base and on the cross brace adjacent to the first end of the support base and including (1) a housing, (2) a motor located in the housing of the pedal unit, (3) two foot-accommodating pedals rotatably mounted on the housing of the pedal unit to rotate in a plane that is upright with respect to the support unit, the pedals being operatively connected to the motor in the pedal unit to be rotated by the motor of the pedal unit when the motor of the pedal unit is suitably activated, each foot-accommodating pedal including (a) an L-shaped drive bar connected to the motor of the pedal unit to be rotated when the motor of the pedal unit is activated, (b) a foot-engaging plate mounted on the drive bar for rotation therewith, each foot-engaging plate including a planar portion, a ledge on one end thereof which extends outwardly from the planar portion and which is located to engage a heel of the foot of the user when the pedal unit is in use, and a strap fixedly attached to the planar portion and which encircles the user's foot to hold the user's foot on the foot-engaging plate when the pedal unit is in use;

D) the seat unit and the pedal unit being mounted on the support base relative to each other so that the user's legs extend in the direction of the longitudinal axis of the support base when the seat unit and the pedal unit are in use; and E) a control unit mounted on the housing of the pedal unit and including (1) a first seat control button operatively connected to the motor in the seat unit, the first seat control button being connected to the motor unit in the seat unit to activate that motor unit in the seat unit to move the seat unit in the longitudinal direction of the support base, (2) a second seat control button operatively connected to the motor in the seat unit, the second seat control button being connected to the motor unit in the seat unit to activate that motor unit in the seat unit to move the bottom of the seat housing to adjust the height of the seat housing with respect to the support base, (3) a control dial that is operatively connected to the motor in the pedal unit to activate the motor in the pedal unit to rotate the foot-accommodating pedals at a rotational speed that corresponds to a setting of the control dial, (4) a timer connected to the motor in the pedal unit, (5) an on/off switch connected to the motor of the seat unit, and (6) an on/off switch connected to the motor of the pedal unit.

2. The recumbent bicycle defined in claim 1 further including a first handlebar mounted on the housing of the seat unit.

3. The recumbent bicycle defined in claim 2 further including a second handlebar mounted on the control unit.

* * * * *